US010927719B2

(12) United States Patent
Olovsson et al.

(10) Patent No.: US 10,927,719 B2
(45) Date of Patent: Feb. 23, 2021

(54) VARIABLE CAM TIMING PHASER HAVING TWO CENTRAL CONTROL VALVES

(71) Applicant: SCANIA CV AB, Södertälje (SE)

(72) Inventors: Daniel Olovsson, Södertälje (SE); Mikael Eriksson, Torslanda (SE)

(73) Assignee: Scania CV AB, Södertälje (SE)

( * ) Notice: Subject to any disclaimer, the term of this patent is extended or adjusted under 35 U.S.C. 154(b) by 98 days.

(21) Appl. No.: 16/301,949

(22) PCT Filed: Apr. 11, 2017

(86) PCT No.: PCT/SE2017/050358

§ 371 (c)(1),
(2) Date: Nov. 15, 2018

(87) PCT Pub. No.: WO2017/204710

PCT Pub. Date: Nov. 30, 2017

(65) Prior Publication Data

US 2020/0318503 A1 Oct. 8, 2020

(30) Foreign Application Priority Data

May 24, 2016 (SE) ..... 1650712-1

(51) Int. Cl.
*F01L 1/344* (2006.01)
*F01L 1/047* (2006.01)

(52) U.S. Cl.
CPC ..... *F01L 1/3442* (2013.01); *F01L 1/34409* (2013.01); *F01L 1/047* (2013.01);
(Continued)

(58) Field of Classification Search
CPC ..... F01L 1/3442; F01L 2001/34426; F01L 2001/34433; F01L 2001/3443;
(Continued)

(56) References Cited

U.S. PATENT DOCUMENTS 5,056,477 A 10/1991 Linder et al.
5,291,860 A 3/1994 Quinn
(Continued)

FOREIGN PATENT DOCUMENTS

CN 101171404 A 4/2008
CN 102003292 A 4/2011
(Continued)

OTHER PUBLICATIONS

Scania CV AB, Swedish Application No. 1950362-2, Office Action, dated Sep. 20, 2019.
(Continued)

*Primary Examiner* — Patrick Hamo
*Assistant Examiner* — Wesley G Harris
(74) *Attorney, Agent, or Firm* — Moore & Van Allen PLLC; W. Kevin Ransom

(57) ABSTRACT

A variable cam timing phaser arrangement is disclosed, comprising: a rotor having at least one vane; a stator co-axially surrounding the rotor, having a recess for receiving the vane of the rotor, wherein the vane divides the recess into a first chamber and a second chamber; and a control assembly for regulating hydraulic fluid flow from the first chamber to the second chamber or vice-versa. The control assembly comprises a central on/off piloted valve allowing or preventing fluid flow along a first unidirectional flow path between the first and second chambers, and a central solenoid valve allowing or preventing fluid flow along a second unidirectional flow path between the first and second chambers in the opposite direction to the first flow path. Also disclosed are an integrated valve unit for use in the variable cam timing phaser arrangement, and a method of controlling the timing of a camshaft.

12 Claims, 4 Drawing Sheets

(52) U.S. Cl.
CPC ..... *F01L 2001/3443* (2013.01); *F01L 2001/34426* (2013.01); *F01L 2001/34433* (2013.01); *F01L 2001/34479* (2013.01); *F01L 2001/34483* (2013.01); *F01L 2250/02* (2013.01); *F01L 2250/04* (2013.01)

(58) Field of Classification Search
CPC ... F01L 1/34409; F01L 2250/04; F01L 1/047; F01L 2001/34479; F01L 2250/02; F01L 2001/34483
USPC ..... 123/90.17, 90.15
See application file for complete search history.

(56) References Cited

U.S. PATENT DOCUMENTS

| | | | | |
|---|---|---|---|---|
| 6,622,675 | B1 | 9/2003 | Simpson | |
| 7,000,580 | B1 | 2/2006 | Smith et al. | |
| 7,311,069 | B2 | 12/2007 | Kobayashi et al. | |
| 7,434,554 | B2 * | 10/2008 | Nagashima | F01L 1/3442 123/90.15 |
| 7,610,884 | B2 * | 11/2009 | Takahashi | F01L 1/3442 123/90.15 |
| 7,931,000 | B2 * | 4/2011 | Ushida | F01L 1/3442 123/90.17 |
| 8,127,725 | B2 | 3/2012 | Crowe et al. | |
| 8,356,583 | B2 * | 1/2013 | Smith | F01L 1/3442 123/90.17 |
| 8,584,636 | B2 | 11/2013 | David et al. | |
| 9,080,470 | B2 | 7/2015 | Wigsten | |
| 10,107,152 | B2 | 10/2018 | Yasuda | |
| 2002/0088413 | A1 | 7/2002 | Smith et al. | |
| 2003/0196616 | A1 | 10/2003 | Simpson | |
| 2005/0028771 | A1 | 2/2005 | Jiang | |
| 2006/0086332 | A1 | 4/2006 | Simpson et al. | |
| 2007/0028874 | A1 | 2/2007 | Simpson | |
| 2007/0107684 | A1 | 5/2007 | Takahashi et al. | |
| 2007/0215084 | A1 * | 9/2007 | Pluta | F01L 1/022 123/90.17 |
| 2007/0251477 | A1 * | 11/2007 | Nozawa | F01L 1/3442 123/90.17 |
| 2008/0135004 | A1 | 6/2008 | Simpson et al. | |
| 2009/0071140 | A1 | 3/2009 | Knecht et al. | |
| 2009/0178635 | A1 | 7/2009 | Takenaka | |
| 2013/0000576 | A1 | 1/2013 | Tanaka et al. | |
| 2013/0139916 | A1 | 6/2013 | Miyachi | |
| 2013/0199478 | A1 | 8/2013 | Tanaka et al. | |
| 2013/0206088 | A1 | 8/2013 | Wigsten | |
| 2013/0291835 | A1 | 11/2013 | Imamura et al. | |
| 2014/0251247 | A1 | 9/2014 | Tewes et al. | |
| 2014/0261263 | A1 * | 9/2014 | Smith | F01L 1/3442 123/90.15 |
| 2014/0261266 | A1 | 9/2014 | Wigsten | |
| 2016/0024980 | A1 | 1/2016 | Sakata et al. | |
| 2016/0108774 | A1 | 4/2016 | Pietrzyk et al. | |
| 2016/0146068 | A1 | 5/2016 | Haltiner, Jr. et al. | |
| 2018/0283232 | A1 * | 10/2018 | McCloy | F01L 1/3442 |
| 2019/0003348 | A1 * | 1/2019 | Smith | F01L 1/34409 |

FOREIGN PATENT DOCUMENTS

| | | | |
|---|---|---|---|
| CN | 102482959 | A | 5/2012 |
| CN | 103069115 | A | 4/2013 |
| DE | 202004021243 | U1 | 4/2007 |
| DE | 102008001801 | A1 | 11/2009 |
| DE | 102008002461 | A1 | 12/2009 |
| DE | 102011055651 | A1 | 5/2013 |
| DE | 102013207616 | A1 | 10/2014 |
| DE | 102014218547 | A1 | 3/2016 |
| DE | 102014220578 | A1 | 4/2016 |
| EP | 1221540 | A2 | 7/2002 |
| EP | 1357261 | A2 | 10/2003 |
| JP | 2010065593 | A | 3/2010 |
| WO | 2012061233 | A2 | 5/2012 |

OTHER PUBLICATIONS

Scania CV AB, International Application No. PCT/SE2017/050358, International Preliminary Report on Patentability, dated Nov. 27, 2018.

Scania CV AB, Chinese Application No. 201780032365.4, First Office Action, dated Apr. 10, 2020.

International Search Report for International Patent Application No. PCT/SE2017/050358 dated Sep. 7, 2017.

Written Opinion of the International Searching Authority for International Patent Application No. PCT/SE2017/050358 dated Sep. 7, 2017.

Office Action from the Swedish Patent Office for International Application No. 1650712-1 dated Dec. 2, 12016.

Office Action from the Swedish Patent Office for International Application No. 1650712-1 dated Oct. 5, 2018.

* cited by examiner

VARIABLE CAM TIMING PHASER HAVING TWO CENTRAL CONTROL VALVES

CROSS-REFERENCE TO RELATED APPLICATIONS

This application is a national stage application (filed under 35 § U.S.C. 371) of PCT/SE2017/050358, filed Apr. 11, 2017 of the same title, which, in turn, claims priority to Swedish Application No. 1650712-1, filed May 24, 2016; the contents of each of which are hereby incorporated by reference.

FIELD OF THE INVENTION

The present invention concerns a variable cam timing phaser arrangement for an internal combustion engine as well as a method for controlling the timing of a camshaft in an internal combustion engine using such a variable cam timing phaser. The invention also concerns an internal combustion engine and a vehicle comprising such a variable cam timing phaser arrangement.

BACKGROUND OF THE INVENTION

The valves in internal combustion engines are used to regulate the flow of intake and exhaust gases into the engine cylinders. The opening and closing of the intake and exhaust valves in an internal combustion engine is normally driven by one or more camshafts. Since the valves control the flow of air into the engine cylinders and exhaust out of the engine cylinders, it is crucial that they open and close at the appropriate time during each stroke of the cylinder piston. For this reason, each camshaft is driven by the crankshaft, often via a timing belt or timing chain. However, the optimal valve timing varies depends on a number of factors, such as engine load. In a traditional camshaft arrangement the valve timing is fixedly determined by the relation of the camshaft and crankshaft and therefore the timing is not optimized over the entire engine operating range, leading to impaired performance, lower fuel economy and/or greater emissions. Therefore, methods of varying the valve timing depending on engine conditions have been developed.

One such method is hydraulic variable cam phasing (hVCP). hVCP is one of the most effective strategies for improving overall engine performance by allowing continuous and broad settings for engine-valve overlap and timing. It has therefore become a commonly used technique in modern compression-ignition and spark-ignition engines.

Both oil-pressure actuated and cam torque actuated hydraulic variable cam phasers are known in the art.

The oil-pressure actuated hVCP design comprises a rotor and a stator mounted to the camshaft and cam sprocket respectively. Hydraulic oil is fed to the rotor via an oil control valve. When phasing is initiated, the oil control valve is positioned to direct oil flow either to an advance chamber formed between the rotor and stator, or a retard chamber formed between the rotor and stator. The resulting difference in oil pressure between the advance chamber and the retard chamber makes the rotor rotate relative to the stator. This either advances or retards the timing of the camshaft, depending on the chosen position of the oil control valve.

The oil control valve is a three-positional spool valve that can be positioned either centrally, i.e. co-axially with the camshaft, or remotely, i.e. as a non-rotating component of the hVCP arrangement. This oil control valve is regulated by a variable force solenoid (VFS), which is stationary in relation to the rotating cam phaser (when the oil control valve is centrally mounted). The variable force solenoid and the spool valve have three operational positions: one to provide oil to the advance chamber, one to provide oil to the retard chamber, and one to refill oil to both chambers (i.e. a holding position).

The established oil pressure actuated hVCP technology is effective in varying valve timing, but has relatively slow phasing velocities and high oil consumption. Therefore, the latest iterations of hVCP technology utilize a technique known as cam torque actuation (CTA). As the camshaft rotates the torque on the camshaft varies periodically between positive torque and negative torque in a sinusoidal manner. The exact period, magnitude and shape of the cam torque variation depends on a number of factors including the number of valves regulated by the camshaft and the engine rotation frequency. Positive torque resists cam rotation, while negative cam torque aids cam rotation. Cam torque actuated phasers utilize these periodic torque variations to rotate the rotor in the chosen direction, thereby advancing or retarding the camshaft timing. In principle they operate as "hydraulic ratchets", allowing fluid to flow in a single direction from one chamber to the other chamber due to the torque acting on the oil in the chambers and causing periodic pressure fluctuations. The reverse direction of fluid flow is blocked by check valve. Therefore, the rotor will be rotationally shifted relative to the stator every period the torque acts in the relevant direction, but will remain stationary when the torque periodically acts in the opposite direction. In this manner, rotor can be rotated relative to the stator, and the timing of the camshaft can be advanced or retarded.

Cam torque actuation systems therefore require check valves to be placed inside the rotor in order to achieve the "hydraulic ratchet" effect. The directing of oil flow to the advance chamber, retard chamber, or both/neither (in a holding position) is typically achieved using a three-positional spool valve. This spool valve can be positioned either centrally, i.e. co-axially with the camshaft, or remotely, i.e. as a non-rotating component of the cam phasing arrangement. The three-positional spool valve is typically moved to each of the three operative positions using a variable force solenoid.

Patent application US 2008/0135004 describes a phaser including a housing, a rotor, a phaser control valve (spool) and a regulated pressure control system (RCPS). The phaser may a cam torque actuated phaser or an oil pressure activated phaser. The RPCS has a controller which provides a set point, a desired angle and a signal bases on engine parameters to a direct control pressure regulator valve. The direct control pressure regulator valve regulates a supply pressure to a control pressure. The control pressure moves the phaser control spool to one of three positions, advance, retard and null, in proportion to the pressure supplied.

There remains a need for improved cam timing phaser arrangements. In particular, there remains a need for cam timing phaser arrangements that are suitable for use commercial vehicles, which are often subject to heavier engine loads and longer service lives as compared to passenger cars.

SUMMARY OF THE INVENTION

The inventors of the present invention have identified a range of shortcomings in the prior art, especially in relation to the use of existing cam phaser arrangements in commercial vehicles. It has been found that the three-positional spool valves of the oil control valve (OCV) in present systems must be precisely regulated and therefore are sensitive to impurities that may jam the spool in a single position. Due to the need for three-position regulation, the solenoids or pressure regulators used in conjunction with the oil control valve must be able to be precisely regulated to provide varying force, in order to attain three positions. This adds considerable mechanical complexity to the system, making it more expensive, more sensitive to impurities and less robust. It also makes the routines for controlling the cam phaser more complex.

It has been observed that that when the oil control valve is solenoid-actuated and centrally mounted the contact between the solenoid-pin and the oil control valve is non-stationary since the oil control valve rotates and the solenoid-pin is stationary. This sliding-contact wears the contact surfaces and the position accuracy of the oil control valve is compromised over the long-term which affects the cam phaser performance. The accuracy of the variable force solenoid itself must also remain high to ensure precise control over the OCV.

Further, oil leakage of existing cam phaser arrangements is also a problem. Cross-port leakage inside the oil control valve cause oil to escape the hydraulic circuit and increase camshaft oscillations due to decreased system stiffness. This leakage also affects the oil consumption of the cam phaser arrangement. It has been observed that the three-positional spool valves used in regulating oil flow offer many different leakage paths for oil to escape the cam phaser chambers. Most noticeable is the sliding contact surface closest to the variable force solenoid where the valve is solenoid-actuated, as well as the port connected to vent. This leakage increases with increased pressure inside the cam phaser chambers since all the pressure spikes in the system must be absorbed by the oil control valve. These pressure spikes are in turn dependent on camshaft torque and may exceed 50 bars for commercial vehicles. Camshaft torques are higher in heavy-duty vehicles, causing higher pressure spikes and even more leakage.

It has been observed that existing cam phasing systems utilizing remotely-mounted oil control valves suffer from even greater system leakage because the pressure spikes from the cam phaser must be transmitted through the camshaft journal bearing before reaching the oil control valve, therefore increasing bearing leakage.

Further, it has been found that the rotor of existing cam torque actuated phasing systems is very compact and complex. Specially-designed check valves must be mounted in the rotor in order to fit in conjunction with the oil control valve. Such check valves are less durable than conventional check valves and add additional expense. Moreover, the rotor requires a complex internal hydraulic pipe system. Due to these requirements, the manufacturing of cam torque actuated cam phasers requires special tools and assembling.

Thus, it is an object of the present invention to provide a variable cam timing phaser arrangement utilizing cam torque actuation that is mechanically simpler, more robust and less prone to oil leakage than known cam torque actuated cam phasers.

This object is achieved by the variable cam timing phaser arrangement according to the appended claims.

The variable cam timing phaser arrangement comprises:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force;

wherein at least one vane divides the at least one recess into an first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa.

The control assembly comprises:

a piloted valve located centrally within the rotor, the piloted valve comprising a pilot port, a first flow port in fluid communication with the first chamber, and a second flow port in fluid communication with the second chamber, wherein the piloted valve is switchable between an open state and a closed state by regulation of the pressure of a pilot fluid at the pilot port, wherein in the open state the piloted valve allows fluid communication between the first chamber and second chamber, and in the closed state the piloted valve prevents fluid communication between the first chamber and the second chamber;

a first check valve arranged in a fluid path between the piloted valve and the first chamber, the first check valve arranged to allow flow from the piloted valve to the first chamber, but to prevent flow from the first chamber to the piloted valve;

a solenoid-controlled actuator located remotely from the rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port;

a central solenoid valve having a valve body arranged co-axially within the rotor and/or camshaft, the central solenoid valve comprising a first flow port in fluid communication with the first chamber and a second flow port in fluid communication with the second chamber, wherein the central solenoid valve is switchable between a closed state preventing fluid communication between the first chamber and second chamber and an open state allowing fluid communication between the first chamber and the second chamber; and a second check valve arranged in a fluid path between the central solenoid valve and the second chamber, the second check valve arranged to allow flow from the central solenoid valve to the second chamber, and to prevent flow from the second chamber to the central solenoid valve.

A variable cam timing phaser arrangement constructed in this manner has a number of advantages. It is constructionally simple, requiring only simple on/off valves to control the cam phaser. The cam phaser is more robust due to less complex and/or less sensitive hydraulic components compared to other cam torque actuated cam phasers. The use of only constructionally robust on/off valves and the avoidance of transferral of pressure spikes through the camshaft bearings means that oil escape paths are fewer and oil consumption lower. The risk of valves jamming is lowered since any valves used need take only two positions meaning that a greater actuating force and/or stronger return mechanisms can be used. More robust solenoids can be used since intermediate position accuracy is not needed. Similarly, no fine multi-pressure regulation is needed to actuate the on/off piloted valve. Further advantages may be apparent to the skilled person.

The variable cam timing phaser arrangement may utilize hydraulic oil as the hydraulic fluid and/or pilot fluid. Cam phasers utilizing hydraulic oil are well established. By utilizing hydraulic oil as the pilot fluid, the construction of the cam phaser arrangement is simplified and alternative routes for refilling the cam phaser with oil are made available.

The piloted valve may be a 2/2 way on/off valve, arranged to be normally in the open state, and actuated by increased fluid pressure at the pilot port to switch to the closed state. Such valves are readily-available, well-established and sufficiently robust to provide reliable service in commercial and heavy vehicle applications.

The solenoid-controlled actuator may be a 3/2 way on/off solenoid valve having an inlet port in fluid communication with a source of increased fluid pressure, an outlet port in fluid communication with the pilot port of the piloted valve, and a vent port, wherein the primary state of the solenoid valve is a de-energized state preventing fluid communication from the source of increased fluid pressure to the pilot port of the piloted valve and allowing fluid communication from the pilot port of the piloted valve to the vent port, and wherein the secondary state of the solenoid valve is an energized state allowing fluid communication from the source of increased fluid pressure to the pilot port of the piloted valve and actuating the piloted valve. Such solenoid valves are readily-available, well-established and sufficiently robust to provide reliable service in commercial and heavy vehicle applications. The solenoid valve may be of the poppet-type, which virtually eliminates the risk for valve jam.

The solenoid-controlled actuator may comprise a solenoid-driven piston arranged in a cylinder, the cylinder being arranged in fluid communication with the pilot port of the piloted valve, wherein the primary state of the solenoid-driven piston is a retracted de-energized state and the secondary state of the solenoid-driven piston is an extended energized state, the extended state increasing the pressure of the fluid at the pilot port of the piloted valve. This increased fluid pressure may be used to actuate the piloted valve. Thus the actuation pressure of the piloted valve need not be dependent on the system oil pressure of the vehicle. Utilizing a cylinder actuator, the actuation pressure can be designed to be higher than the oil system pressure, or lower, if desired. This allows for greater system robustness.

The central solenoid valve may be a 2/2 way on/off solenoid valve arranged to be normally in the closed state, and actuated by energizing the solenoid to switch to the open state. Such valves are again readily-available, well-established and sufficiently robust to provide reliable service in commercial and heavy vehicle applications.

From a failsafe perspective it may be an advantage having a piloted valve that is normally open in combination with a central solenoid valve that is normally closed. Thus, in the event of solenoid failure, the rotor is moved to base position by cam torque actuation, meaning that the use of a torsion spring biasing mechanism for the rotor may be avoided.

A source of increased fluid pressure, such as a main oil gallery, may be arranged in fluid communication with the first chamber and the second chamber via a first refill channel and a second refill channel, the first refill channel and second refill channel each having a check valve arranged to prevent fluid flow from the first chamber or second chamber to the source of increased fluid pressure. This ensures that the cam phaser is sufficiently supplied with oil for optimal performance and that the cam phaser system is sufficiently rigid to avoid camshaft vibration.

The piloted valve, the central solenoid valve, the first check valve and the second check valve may be integrated into a single integrated valve unit arranged co-axially with the rotor. The use of an integrated valve unit reduces the number of separate components needed to control the cam phaser, thereby simplifying manufacture and reducing manufacturing cost.

The integrated valve unit comprises:

a cylindrical housing comprising a cylindrical wall, a first end wall arranged to seal a first end of the cylindrical housing and a second end wall arranged to seal a second end of the cylindrical housing, wherein the cylindrical wall of the housing comprises a first hole through the cylindrical wall in proximity to the first end wall of the housing, a second hole through the cylindrical wall in proximity to a middle portion of the cylindrical housing, and a third hole through the cylindrical wall in proximity to the second end wall of the housing;

a first valve seat arranged in the housing between the first hole and the second hole;

a second valve seat arranged in the housing between the second hole and the third hole;

a first valve member arranged to be normally seated on the first valve seat, the first valve member arranged to prevent flow from the first hole to the second hole, but to allow flow from the second hole to the first hole;

a second valve member arranged to be normally seated on the second valve seat, the second valve member arranged to prevent flow from the second hole to the third hole, and to allow flow from the third hole to the second hole;

a first valve sleeve arranged outside and co-axially with the housing in proximity to the first end of the housing and arranged to be moveable between an open position and a closed position when subjected to altered external fluid pressure from a pilot fluid, wherein the open position allows fluid flow through the first hole, and the closed position prevents fluid flow through the first hole; and a second valve sleeve arranged outside and co-axially with the housing in proximity to the second end of the housing and arranged to be moveable between a closed position and an open position by the action of a solenoid, wherein the closed position prevents fluid flow through the third hole, and the open position allows fluid flow through the third hole.

Using such a construction, the integrated valve unit can be formed from well-proven valve components such as sliding valve sleeves and valve members such as ball or disc valve members. Since much functionality is incorporated into a single unit, space is saved. The check valve functionality is located centrally in the integrated valve unit meaning that conventional robust valve members and seats can be used, in contrast to small, specially manufactured radially placed check valves in known commercial cam-toque actuated phasers.

The first hole and the third hole may each arranged to be in fluid communication with a first chamber of the variable cam timing phaser arrangement, and the second hole may be arranged to be in fluid communication with a second chamber of the variable cam timing phaser arrangement. Connected in this manner, the integrated valve unit may be used as a direct replacement for the piloted valve, central solenoid valve, first check valve and second check valve as described above.

The first valve sleeve may normally be in the open position and may be moveable to the closed position when subjected to increased fluid pressure. The second valve sleeve may be normally in the closed position and may be moveable to the open position by energizing the solenoid. Thus, if the solenoids fail to actuate, the integrated valve unit returns the rotor to base position using cam torque actuation, meaning that a torsion spring may not be required to bias the cam phaser to base position.

According to another aspect of the invention, a first method for controlling the timing of a camshaft in an internal combustion engine comprising a variable cam timing phaser arrangement as described above is provided. The method comprises the steps:

i. providing the solenoid-controlled actuator in a secondary state, thereby providing the piloted valve in a closed state, and providing the central solenoid valve in a closed state;

ii. switching the solenoid-controlled actuator to the primary state, thereby switching the piloted valve to an open state, whereby fluid will flow from the second chamber to the first chamber due to periodic pressure fluctuations in the first chamber and second chamber caused by torque acting on the camshaft, and whereby fluid is prevented from flowing from the first chamber to the second chamber, resulting in the rotor rotating in a first rotational direction relative to the stator and the cam timing being adjusted in a first temporal direction;

iii. maintaining the solenoid controlled actuator in the primary state until a desired degree of cam timing phasing is achieved; and iv. switching the solenoid-controlled actuator to a secondary state, thereby switching the piloted valve to a closed state, whereby fluid communication between the first chamber and the second chamber is prevented and the desired degree of cam timing phasing is maintained.

According to yet another aspect of the invention, a second method for controlling the timing of a camshaft in an internal combustion engine comprising a variable cam timing phaser i. providing the solenoid-controlled actuator in a secondary state, thereby providing the piloted valve in a closed state, and providing the central solenoid valve in a closed state;

ii. switching the central solenoid valve to the open state, whereby fluid will flow from the first chamber to the second chamber due to periodic pressure fluctuations in the first chamber and second chamber caused by torque acting on the camshaft, and whereby fluid is prevented from flowing from the second chamber to the first chamber, resulting in the rotor rotating in a second rotational direction relative to the stator and the cam timing being adjusted in a second temporal direction, wherein the second temporal direction is opposite to the first temporal direction;

iii. maintaining the central solenoid valve in an open state until a desired degree of cam timing phasing is achieved; and iv. switching the central solenoid valve to a closed state, whereby fluid communication between the first chamber and the second chamber is prevented and the desired degree of cam timing phasing is maintained.

These methods provides a simple, reliable way of controlling cam phasing, requiring controlling of only two on/off solenoids to provide phasing in either direction, or holding of the current phasing.

According to a further aspect an internal combustion engine comprising a variable cam timing phaser arrangement as described above, and/or an integrated valve unit for a variable cam timing phaser arrangement as described above, is provided.

According to yet a further aspect of the invention, a vehicle comprising a variable cam timing phaser arrangement as described above, and/or an integrated valve unit for a variable cam timing phaser arrangement as described above, is provided.

DETAILED DESCRIPTION OF THE INVENTION

Figure 1:
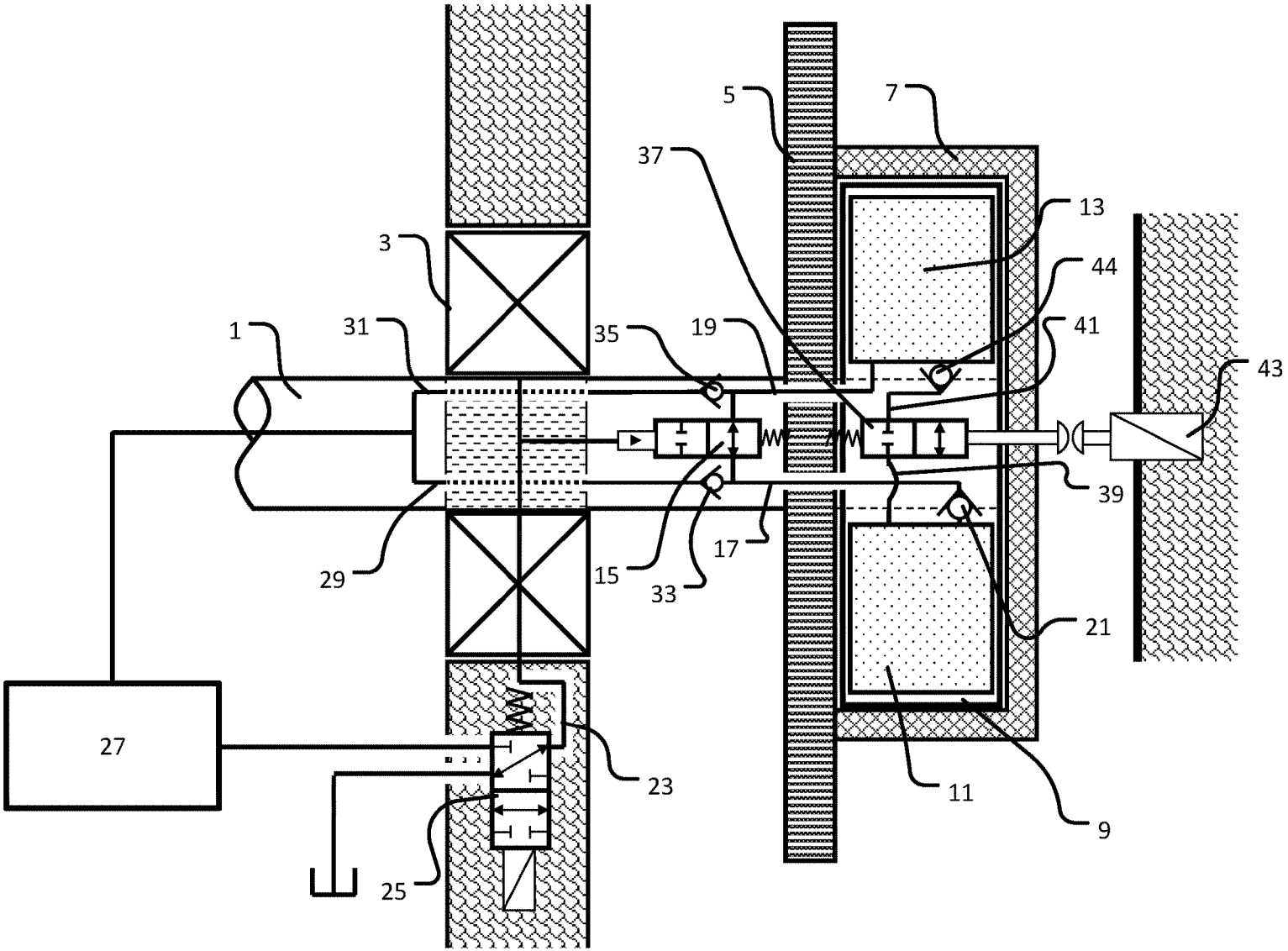
FIG. 1 illustrates schematically one embodiment of a variable cam timing phaser arrangement according to the present disclosure.

The present invention is based on the realization that cam torque actuated cam phasing can be achieved by utilizing control assembly comprising a centrally-mounted on/off piloted valve together with a centrally mounted on/off solenoid valve, instead of the multi-positional spool valve known in the prior art. With a combination of two separately regulated on/off valves, together with appropriately positioned check valves, fluid flow can be controlled to advance, retard or hold the camshaft timing, using only simple, robust components. No multi-force actuators, such as variable force solenoids or pressure regulator valves are required since no multi-positional regulation is required. The two control valves can be integrated into a single unit and therefore require no more space than the multi-positional spool vales of the prior art.

The cam timing phaser arrangement of the present invention comprises a rotor, a stator co-axially surrounding the rotor, and a control assembly.

The cam phaser rotor is arranged to be connected to a camshaft of the internal combustion engine. This can be an intake valve camshaft, exhaust valve camshaft, or any other camshaft in the engine such as a combined intake/exhaust camshaft. The rotor has at least one vane, but may preferably have a plurality of vanes, such as three, four, five or six vanes. Separate oil channels for channelling oil to and from the piloted valve of the control assembly are provided at each side of at least one of the vanes, but preferably at each side of each of the vanes.

The stator is arranged for accepting drive force. This may for example be by connecting the stator to a cam sprocket, which takes up drive force from the crankshaft via the timing belt. The stator may also be constructionally integrated with the cam sprocket. The stator co-axially surrounds the rotor and has at least one recess for accepting the at least one vane of the rotor. In practice, the stator has the same number of recesses as the number of rotor vanes. The recesses in the stator are somewhat larger than the rotor vanes, meaning that when the rotor is positioned in the stator with the vanes centrally positioned in the recesses, a chamber is formed at each side of each rotor. These chambers can be characterized as first chambers, rotating the rotor in a first direction relative to the stator when filled with hydraulic oil, and second chambers, rotating the rotor in a second direction relative to the stator when filled with hydraulic oil.

The control assembly comprises a piloted valve, a remotely-located solenoid-controlled actuator for actuating the piloted valve, a first check valve arranged in a fluid path between the piloted valve and the first chamber, a central solenoid valve, and a second check valve arranged in a fluid path between the central solenoid valve and the second chamber.

Where valves are referred to as "on/off" this refers to a valve having only two states: an open state and a closed state. Such valves may however have more than two ports. For example, a 3/2 way on/off valve has three ports and two states. Such a valve often connects two flow ports when open and connects one of the flow ports to a vent/exhaust port when closed.

Where valves or valve sleeves are referred to as "normally closed/open/on/off" this refers to the state of the valve when non-actuated. For example, a normally open solenoid valve is held in the open position when not actuated/energized, commonly using a return such as a spring return. When the normally open solenoid valve is actuated/energized the solenoid acts with a force sufficient to overcome the force of the return holding the valve open, and the valve is therefore closed. Upon de-actuation/de-energization, the return returns the valve to the open state.

Where components are stated to be in "fluid communication" or flow is allowed or prevented "between" components, this flow is to be interpreted as not necessarily directional, i.e. flow may proceed in either direction. Directional flow in a single direction is denoted as flow "from" a component "to" another component.

The piloted valve is located centrally in the cam phaser, such as coaxially within the rotor or camshaft, and rotates together with the rotor and camshaft. It may be a separate component or may be integrated with one or more further valves of the control assembly. The piloted valve may be a 2/2 way on/off valve, i.e. a valve having two flow ports, i.e. a first and second port, and two positions (open or closed). The piloted valve is in fluid communication with an oil channel leading to the first chambers at the first port and is in fluid communication with an oil channel leading to the second chambers at the second port. Therefore, fluid communication between the first and second chambers is established when the valve is open. The pilot valve also has a pilot port connected to the pilot fluid feed. The switching of the on/off piloted valve is regulated by the pressure of the pilot fluid at the pilot port; the pressure of the pilot fluid being regulated by a remotely-placed solenoid actuator. The pilot fluid may be air, i.e. the piloted valve may be pneumatically actuated. However, it is preferable that the pilot fluid is hydraulic oil since this considerably simplifies the system design, due to hydraulic oil already being used in the cam phaser arrangement. The pilot valve may be normally closed, i.e. be closed when non-actuated. However it may also be normally open, i.e. open and allowing fluid communication between the first chamber and the second chamber when non-actuated. The piloted valve may be any suitable valve type known in the art, including but not limited to a poppet valve, sliding spool valve and rotary spool valve. The valve may have a return spring.

The solenoid actuator regulates the pilot fluid pressure in order to actuate the piloted valve. This may be done by increasing the pressure to actuate the piloted valve by "pushing". However the piloted valve may also be actuated by a "pulling" effect using decrease pilot fluid pressure. The solenoid actuator may be an on/off solenoid valve that increases fluid pressure by connection to a source of fluid pressure, such as the main oil gallery if oil is used as the pilot fluid. It can, for example be a 3-port, 2-position on/off solenoid valve being connected to an oil gallery at the inlet port, at the outlet port being connected to an oil channel leading to the pilot port of the pilot valve, and having a vent port for release of oil pressure from the channel leading to the pilot port when in the "off" position. It may normally be in the "off" position when the solenoid is not actuated, and switch to the "on" position upon activation of the solenoid. The solenoid valve may be any suitable valve type known in the art, including but not limited to a poppet valve, sliding spool valve and rotary spool valve. The use of a poppet valve virtually eliminates the risk for valve jam.

The solenoid actuator may also be an oil-filled cylinder in fluid connection with the pilot port of the piloted valve. An on/off solenoid-actuated piston is provided in the cylinder. The solenoid-actuated piston may push down on the volume of oil in the cylinder upon actuation, leading to increased pressure at the pilot port. Alternatively, the solenoid-actuated piston may retract in the cylinder upon actuation, leading to decreased oil pressure at the pilot valve, and therefore a "pull" effect.

The solenoid actuator may be located remotely from the rotating components of the cam phaser arrangement, such as on or in proximity to the camshaft bearings, or on another non-rotating component of the internal combustion engine.

A first check valve is arranged in the fluid path between the piloted valve and the first chamber. This check valve may be a separate component or may be integrated with the pilot valve and/or other valves of the control assembly. The first check valve serves to allow only unidirectional flow in the direction from the second chamber to the first chamber whenever the piloted valve is open. That is to say that the first check valve prevents flow from the first chamber to the second chamber.

The central solenoid valve has a valve body located centrally in the cam phaser, such as coaxially in the rotor or camshaft, and this valve body rotates together with the rotor and camshaft. The solenoid actuating the central solenoid valve may be mounted externally to the rotor, in close proximity to the rotor and centred on the rotation axis of the rotor. The solenoid is stationary with respect to the rotating components of the cam phaser arrangement. The valve body of the central solenoid valve may be a separate discrete component, or it may be integrated with one or more further valves of the control assembly. The central solenoid valve has a first port in fluid communication with the first chamber and a second port in fluid communication with the second chamber. It has two states, an open position and a closed position. Whenever in the open position it allows fluid communication between the second chamber and the first chamber, and in the closed position no fluid communication is allowed between the second chamber and first chamber via the central solenoid valve. The central solenoid valve may be a 2/2 way on/off solenoid valve. It may be normally closed, meaning that it is closed in the "off" position and open in the "on" position. Alternatively, it may be normally open. The central solenoid valve may be any suitable valve type known in the art, including but not limited to a poppet valve, sliding spool valve and rotary spool valve. The valve may have a return spring.

A second check valve is arranged in the fluid path between the central solenoid valve and the second chamber. This check valve may be a separate component or may be integrated with the central solenoid valve and/or other valves of the control assembly. The second check valve serves to allow only unidirectional flow in the direction from the first chamber to the second chamber whenever the central solenoid valve is open. That is to say that the second check valve prevents flow from the second chamber to the first chamber.

The piloted valve, its solenoid actuator and the first check valve together serve to control a first unidirectional fluid path from the second chamber to the first chamber. When the piloted valve is closed, no fluid flow via the piloted valve is possible. Whenever the piloted valve is opened, one-way fluid flow is allowed from the second chamber to the first chamber, but flow in the opposite direction via the piloted valve is prevented.

In a similar manner, the central solenoid valve and the second check valve together serve to control a first unidirectional fluid path from the first chamber to the second chamber. When the central solenoid valve is closed, no fluid flow via the central solenoid valve is possible. Whenever the central solenoid valve is opened, one-way fluid flow is allowed from the first chamber to the second chamber, but flow in the opposite direction via the piloted valve is prevented.

Therefore, the control assembly functions as two separate "hydraulic ratchet" paths between the first chamber and the second chamber, each "hydraulic ratchet" path controlled by one of the central valves. If the piloted valve is open and the central solenoid valve is closed, fluid can flow only from the second chamber to the first. Therefore, whenever periodic variations in camshaft torque result in the second chamber having higher fluid pressure than the first chamber, fluid flows from the second to the first chamber. However, whenever the pressure in the first chamber is higher than in the second, the opposite flow direction is prevented. Therefore, opening the piloted valve and closing the central solenoid valve will result in the rotor rotating in a first direction relative to the stator. If the central solenoid valve is open and the piloted valve is closed, fluid can flow only from the first chamber to the second. Therefore, whenever periodic variations in camshaft torque result in the first chamber having higher fluid pressure than the second chamber, fluid flows from the first to the second chamber. However, whenever the pressure in the second chamber is higher than in the first, the opposite flow direction is prevented. Therefore, opening the central solenoid valve and closing the piloted valve will result in the rotor rotating in a second direction relative to the stator, the second direction being the opposite direction to the first direction.

In one embodiment, the piloted valve, central solenoid valve, first check valve and second check valve may be integrated into a single integrated valve unit. In this case, the control assembly comprises a single centrally located integrated valve unit, a remotely located solenoid actuator for actuating the piloted valve component (first valve sleeve) of the integrated valve unit, and a central but stationary mounted solenoid for actuating the solenoid valve component of the integrated valve unit.

The integrated valve unit will now be described in detail.

A cylindrical housing comprising a cylindrical wall, a first end wall arranged to seal a first end of the cylindrical housing and a second end wall arranged to seal a second end of the cylindrical housing. The cylindrical housing is preferably circle cylindrical and preferably has rotational symmetry along the longitudinal axis. The cylindrical wall of the housing has three sets of holes through the housing wall for allowing fluid communication with the housing. Each set of holes comprises at least one hole, but preferably two or more holes, such as four of more holes, or six or more holes. The holes of each set are preferably evenly spaced around the circumference of the circular wall of the housing. Each hole through the housing may be circular, but it may also be elongated in either the radial direction or longitudinal direction of the housing, in relation to the longitudinal rotational symmetry axis of the housing.

The first set of holes is located in proximity to the first end wall of the housing, the second set of holes is located in proximity to a middle portion of the cylindrical housing, and the third set of holes are located in proximity to the second end wall of the housing.

Within the housing, a first valve seat is arranged between the first set of holes and the second set of holes, and a second valve seat is arranged between the second set of holes and the third set of holes.

A first valve member is arranged in the housing, on the side of the first valve seat closer to the first end wall of the housing. This valve member is normally seated on the first valve seat, thus forming a seal and preventing flow from the first set of holes to the second set of holes. However, flow in the direction of from the second set of holes to the first set of holes will unseat the valve member and therefore flow in this direction is allowed.

A second valve member is arranged in the housing, between the first valve seat and the second valve seat. The second valve member is normally seated on the second valve seat, forming a seal and therefore preventing flow from the second set of holes to the third set of holes. However, when subjected to flow from the third set of holes, the second valve member is displaced, allowing flow to the second set of holes.

The first and second valve members may be any valve members known in the art, such as disc valve members or ball valve members. The check valves may be biased towards the normally seated position by any known means, including springs.

The overall flow directions allowed by the housing together with the valve seats and valve members is therefore from the second set of holes to the first set of holes; and from the third set of holes to the second set of holes. The flow directions prevented are flow from the first set of holes to the second or third set of holes; or flow from the second set of holes to the third set of holes.

Two valve sleeves are arranged outside of the housing and coaxially with the housing. The first valve sleeve is arranged in proximity to the first end of the housing. The first valve sleeve can be moved between an open position and a closed position when subjected to altered external fluid pressure from a pilot fluid. The open position allows fluid flow through the first set of holes, and the closed position prevents fluid flow through the first holes. Thus, the closed position prevents flow from the second or third set of holes to the first set of holes. The open/close function of the valve sleeve can be attained for example by having holes in the first valve sleeve corresponding to those of the first set of holes in the valve housing. When the holes in the valve sleeve are aligned with those in the valve housing, flow is allowed; when the holes are non-aligned flow is prevented. The first valve sleeve can be moved between the open and closed positions by translational movement in a direction along the longitudinal axis of the housing. However, a rotational motion around the longitudinal axis is also conceivable as a method of switching between the two states. The first valve sleeve may be biased using for example a spring return member so that it is normally open. Alternatively, it may be normally closed.

The second valve sleeve is arranged in proximity to the second end of the housing. The second valve sleeve can be moved between an open position and a closed position when subjected to an actuating force from a solenoid actuator. The open position allows fluid flow through the third set of holes, and the closed position prevents fluid flow through the third holes. This can be attained for example by having holes in the second valve sleeve corresponding to those of the third set of holes in the valve housing. When the holes in the valve sleeve are aligned with those in the valve housing, flow is allowed; when the holes are non-aligned flow is prevented. The third valve sleeve can be moved between the open and closed positions by translational movement in a direction along the longitudinal axis of the housing. However, a rotational motion around the longitudinal axis is also conceivable as a method of switching between the two states. The second valve sleeve may be biased using for example a spring return member so that it is normally closed. Alternatively, it may be normally open.

The second set of holes is never covered by a valve sleeve and therefore is always open to fluid communication.

The valve housing and valve sleeves may be encompassed by an integrated valve enclosure that holds the various parts in correct relation to each other and allows fluid connection to the first and second chambers. The first set of holes and the third set of holes are arranged in fluid connection with the first chamber, and the second set of holes is arranged in fluid connection with the second chamber. When arranged in this manner, the integrated valve unit acts in an analogous manner to the non-integrated control assembly as described above. The first valve sleeve is analogous to the piloted valve and the second valve sleeve is analogous to the central solenoid valve. The check valve functions are performed by the valve housing, valve seats and valve members. Having the first valve sleeve opened and the second valve sleeve closed allows unidirectional flow from the second chamber to the first, but prevents flow in the opposite direction. Having the second valve sleeve opened and the first valve sleeve closed allows unidirectional flow from the first chamber to the second, but prevents flow in the opposite direction.

The oil pressure may be maintained in the cam phaser system of the invention by connection to a source of oil pressure, such as the main oil gallery. For example, such connection points may be arranged on the fluid channels leading from the first and/or second chambers to the piloted valve. Such connection points may also be arranged in conjunction with the solenoid actuator, for example as a connection to the inlet port of a solenoid valve (as previously mentioned), or in conjunction with an oil-filled cylinder. The channel(s) connecting to the source of oil pressure may be provided with a check valve(s) to prevent backflow of oil from the cam phaser assembly to the source of oil pressure.

The cam phaser assembly may also be provided with a number of failsafe features. For example, a pressure-actuated lock pin may be arranged in at least one of the vanes of the rotor, together with a corresponding recess in the stator for receiving the lock pin. The recess for receiving the locking pin is located at a base position, i.e. either fully advanced or fully retarded. A torsion spring may be provided in order to bias the rotor towards the base position in the event of system failure. However, the control assembly of the cam phaser may also be biased so that one of the control valves is normally open and the other normally closed, meaning that in the event of electrical failure of the solenoids, the rotor will be used to base position by cam torque actuation. Therefore, no torsion spring is necessary. The lock pin is normally in the deployed (locking) position, and is actuated to the retracted (unlocked) position when the pressure in a component of the cam phaser arrangement exceeds a threshold pressure. For example, the lock pin may be in fluid connection with one or more channels leading from a chamber to the piloted valve.

The means of controlling phasing using the variable cam timing phaser arrangement of the present disclosure is the same regardless of whether the control assembly comprises separate valve components or an integrated valve unit. When camshaft phasing is desired, one of the control valves is open and the other is closed in order to allow unidirectional flow from one chamber to the other. The periodic variation in torque acting on the camshaft results in periodic fluctuations in each of the two chambers relative to the other chamber. When the pressure difference acts in the allowed direction of flow, fluid will flow between the two chambers in the allowed direction. When the pressure difference acts in the opposite direction the control assembly will act as a check valve and prevent flow. Thus, the rotor will gradually be rotated relative to the stator in the desired direction and the camshaft timing will be altered. So, for example opening the piloted valve and closing the central solenoid valve will rotate the rotor in a first direction relative to the stator, whereas closing the piloted valve and opening the central solenoid valve will rotate the rotor in a second direction relative to the stator, wherein the second direction is opposite to the first direction. If holding of the phasing is desired, both the piloted valve and the central solenoid valve are closed and fluid if therefore prevented from flowing in both directions between the first chamber and the second chamber.

The invention will now be illustrated with reference to the figures.

FIG. 1 shows one embodiment of the disclosed variable cam timing phaser arrangement. A camshaft 1 rests on camshaft bearing 3. At the end of the camshaft 3 is a cam sprocket 5. Fixed to the cam sprocket is a stator 7. Co-axially arranged within the stator is a rotor 9. The rotor 9 is fixed to the end of the camshaft 1. The stator 7 and vanes (not shown) of the rotor 9 together form at least one first chamber 11 and at least one second chamber 13. By varying the oil quantity to and from the first 11 and second 13 chambers, the angle of the rotor 9 relative to the stator 7 can be varied. Since the rotor 9 is fixed to the camshaft 1 and the stator 7 is fixed to the cam sprocket 5, the angle between the camshaft 1 and cam sprocket 5 is also varied and the valve timing of the internal combustion engine is altered.

A control assembly is used to regulate the fluid flow to and from the first chamber 11 and second chamber 13. The control assembly comprises a 2/2 way fluid-pressure piloted valve 15. The piloted valve 15 is located centrally in an end of the camshaft 1 in proximity to the rotor 9. A first port of the piloted valve 15 is in fluid connection with the first chamber 11 via a first oil channel 17, and a second port of the piloted valve 15 is in fluid communication with the second chamber 13 via a second oil channel 19. A first check valve 21 is arranged in the first oil channel 17 in order to allow flow from the piloted valve 15 to the first chamber 11, but to prevent flow in the opposite direction.

A pilot oil channel 23 leads from the pilot port of the pilot valve 15 to an outlet port of a 3/2 way on/off solenoid valve 25. The solenoid valve 25 is located on the cam bearing holder. The inlet port of the solenoid valve 25 is connected to a source of oil pressure 27 such as the main oil gallery, and the remaining port of the solenoid valve 25 is a vent port. Oil refill channels 29, 31 leading from the source of oil pressure 27 adjoin the first oil channel 17 and second oil channel 19 respectively. Each of the oil refill channels 29, 31 is fitted with a check valve (33, 35) preventing oil backflow from the first and second oil channels 17, 19.

A central 2/2 way solenoid valve 37 is arranged having a valve body 37 located centrally within the rotor 9, and an external stationary solenoid 43 to control the valve body. A first port of the central solenoid valve 37 is in fluid connection with the first chamber 11 via a third oil channel 39, and a second port of the central solenoid valve 37 is in fluid communication with the second chamber 13 via a fourth oil channel 41. A second check valve 44 is arranged in the fourth oil channel 41 in order to allow flow from the central solenoid valve 37 to the second chamber 13, but to prevent flow in the opposite direction.

The piloted valve 15 is open when not actuated by increased fluid pressure and the solenoid valve 25 is closed (leads the pilot oil channel 23 to vent) when not actuated. The central solenoid valve 37 is closed when not actuated. Thus, when solenoid valves 25 and 35 are not energized, oil can flow from the second chamber 13 to the first chamber 11, but not from the first chamber 11 to the second chamber 13. Thus, this mode acts both a phasing mode in a first direction, as well as a failsafe mode moving the rotor to base position in the event that the solenoids of the solenoid valves 25 and 35 fail. In a second mode, remote solenoid valve 25 is energized, resulting in the piloted valve 15 being closed, and central solenoid valve 37 is not energized and therefore closed. In this mode, no oil flow between the chambers is possible and the phasing is therefore held. In a third mode, remote solenoid valve 25 is energized, resulting in the piloted valve 15 being closed, and central solenoid valve 37 is energized and therefore open. Thus, in this mode, oil can flow from the first chamber to the second chamber and this mode therefore provides phasing in a second direction opposite to the first. As previously noted, the central solenoid valve 37 rotates together with the rotor 9 and camshaft 1, whereas the solenoid 43 controlling the valve 37 does not rotate, i.e. is stationary. This means that there is sliding contact between the armature of the solenoid 43 and the central solenoid valve 37. However, the armature of the solenoid 43 of the central solenoid valve 37 need only be in contact with the valve 37 whenever phasing in the second direction is required, meaning that the sliding contact is minimal in duration as compared to prior art solutions where sliding contact is required to obtain a phasing holding mode.

Figure 2A:
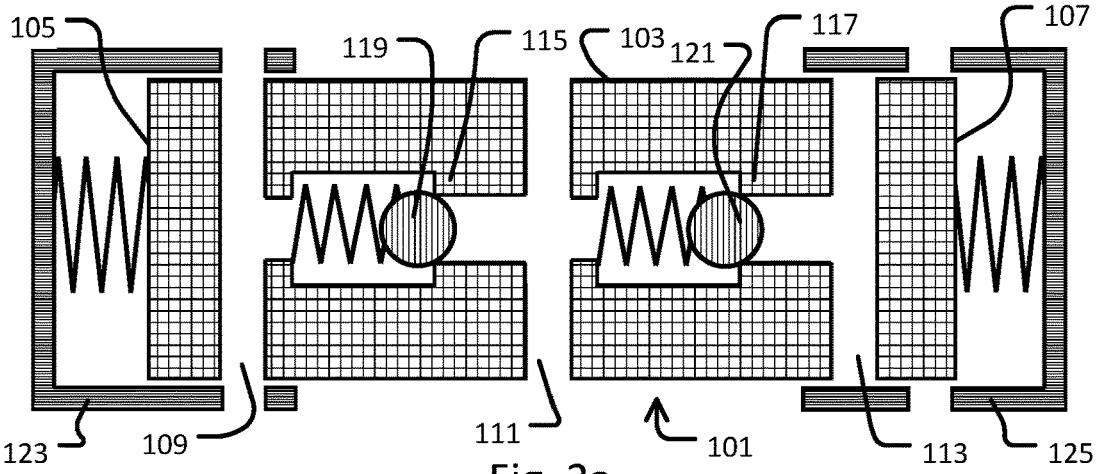
FIG. 2*a* illustrates schematically an integrated valve unit for use as a component of a variable cam timing phaser arrangement according to the present disclosure.

FIG. 2 shows an integrated valve unit according to the present disclosure. FIG. 2*a* shows the integrated valve unit in the non-actuated state. The valve unit comprises a valve housing 101 having a cylindrical wall 103, a first end wall 105 at a first end of the housing 101, and a second end wall 107 at a second end of the housing 101. A first set of holes 109 through the cylindrical wall 103 is provided in proximity to the first end wall 105. A second set of holes 111 through the cylindrical wall 103 is provided in proximity to a middle portion of the cylindrical wall 103. A third set of holes 113 through the cylindrical wall 103 is provided in proximity to the second end wall 107. A first valve seat 115 is located in the housing 101 between the first set of holes 109 and the second set of holes 111. A second valve seat 117 is located between the second set of holes 111 and the third set of holes 113. A first spring-biased ball valve member 119 is arranged in the housing 101 to be normally seated on the first valve seat 115. A second spring-biased ball valve member 121 is arranged to be normally seated on the second valve seat 117. A first valve sleeve 123 is arranged to co-axially surround the first end of the housing 101. The first valve sleeve 123 allows flow through the first set of holes 109 when in a first position and prevents flow through the first set of holes whenever in a second position. The first valve sleeve is normally in the open position and is moved to the closed position by increased oil pressure from the remote solenoid actuator 25 (not shown). A second valve sleeve 125 is arranged to co-axially surround the second end of the housing 101. The second valve sleeve 125 prevents flow through the third set of holes 113 when in a first position and allows flow through the third set of holes 113 whenever in a second position. The third valve sleeve is normally in the first (closed) position and is moved to the second (open) position by solenoid 43 (not shown).

The first set of holes 109 and third set of holes 113 are arranged in fluid communication with the first chamber 11 (not shown). The second set of holes is arranged in fluid communication with the second chamber 13 (not shown).

Figure 2B:
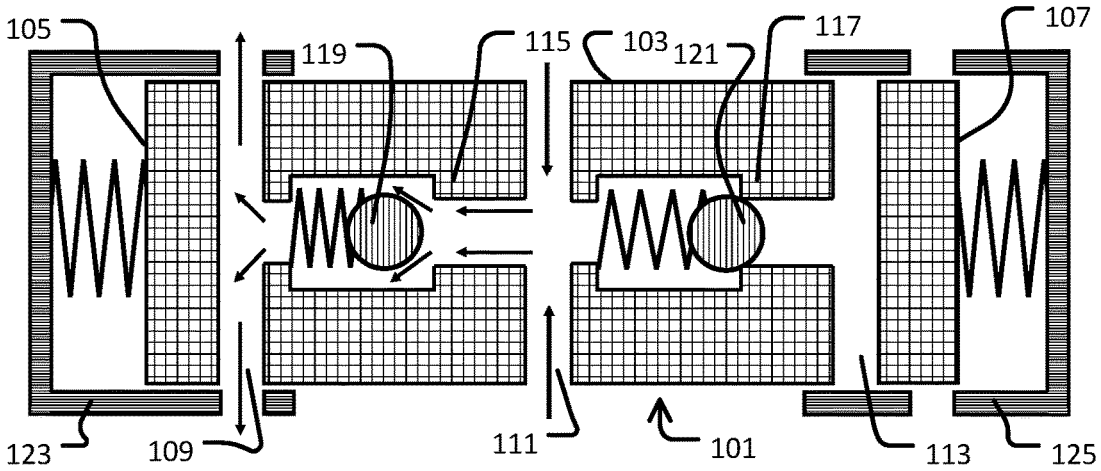
FIG. 2*b* illustrates schematically a first flow path in an integrated valve unit according to the present disclosure.
Figure 2C:
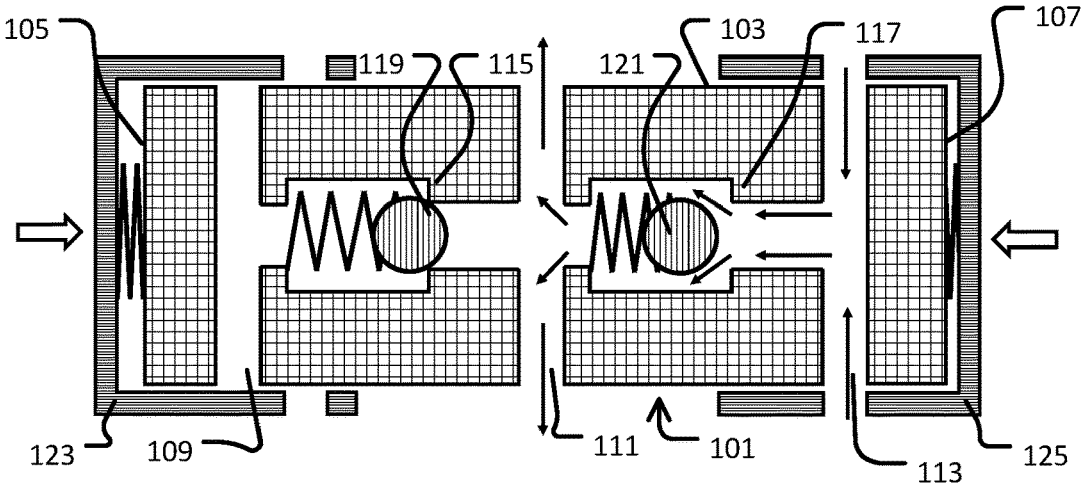
FIG. 2*c* illustrates schematically a second flow path in an integrated valve unit according to the present disclosure.

FIGS. 2*b* and 2*c* show the fluid flow paths for rotating the rotor 9 relative to the stator 7 in both directions. The flow paths are indicated with arrows.

FIG. 2*b* shows the flow path whenever the first valve sleeve 123 is non-actuated (open) and the second valve sleeve 125 is non-actuated (closed). Whenever the first valve sleeve is open, and the second valve sleeve is closed, oil may flow from the second chamber 13 to the first chamber 11 via the second set of holes 111 and first set of holes 109. The reverse flow direction is checked by ball valve member 119 and therefore flow from the first chamber 11 to the second chamber 13 is prevented. Thus, a "hydraulic ratchet" effect, allowing unidirectional flow in a first direction is obtained.

FIG. 2*c* shows the flow path whenever the first valve sleeve 123 is actuated (closed) and the second valve sleeve 125 is actuated (open). Whenever the first valve sleeve is closed, and the second valve sleeve is open, oil may flow from the first chamber to the second chamber via the third set of holes 113 and second set of holes 111. The reverse flow direction is checked by ball valve member 121 and therefore flow from the second chamber 13 to the first chamber 11 is prevented. Thus, a "hydraulic ratchet" effect, allowing unidirectional flow in a second direction opposite to the first direction is obtained.

When both valve sleeves 123, 125 are closed (not shown), no flow is possible between the first chamber 11 and second chamber 13, and therefore cam phase holding is achieved.

Figure 3:
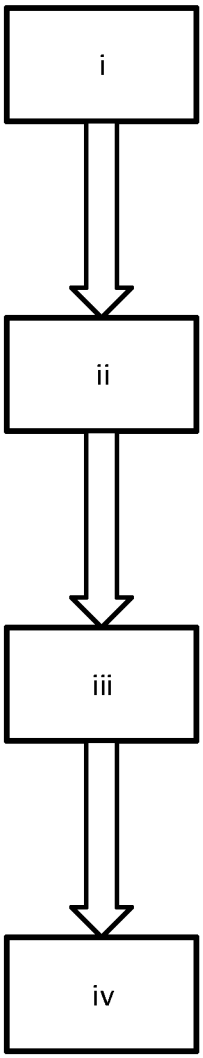
FIG. 3 shows a process chart for a method for controlling the timing of a camshaft in an internal combustion engine according to the present disclosure.

FIG. 3 shows a process flow diagram for a method of controlling the timing of a camshaft in an internal combustion engine comprising a variable cam timing phaser arrangement as disclosed.

In step i. both the piloted valve and the central solenoid valve are closed and the cam phaser is therefore provided in a holding mode.

In step ii. either one of the piloted valve or the central solenoid valve is opened to allow unidirectional flow between the first chamber and the second chamber in a single direction, wherein flow in the reverse direction is prevented by the check valve functionality of the control assembly.

In step iii. the valves are maintained in the same state as in step ii. for the required period of time for the desired degree of cam phasing to be obtained.

In step iv. both the central solenoid valve and the piloted valve are closed to prevent fluid communication between the first and second chambers and to set the cam phaser to a phase holding state.

Figure 4:
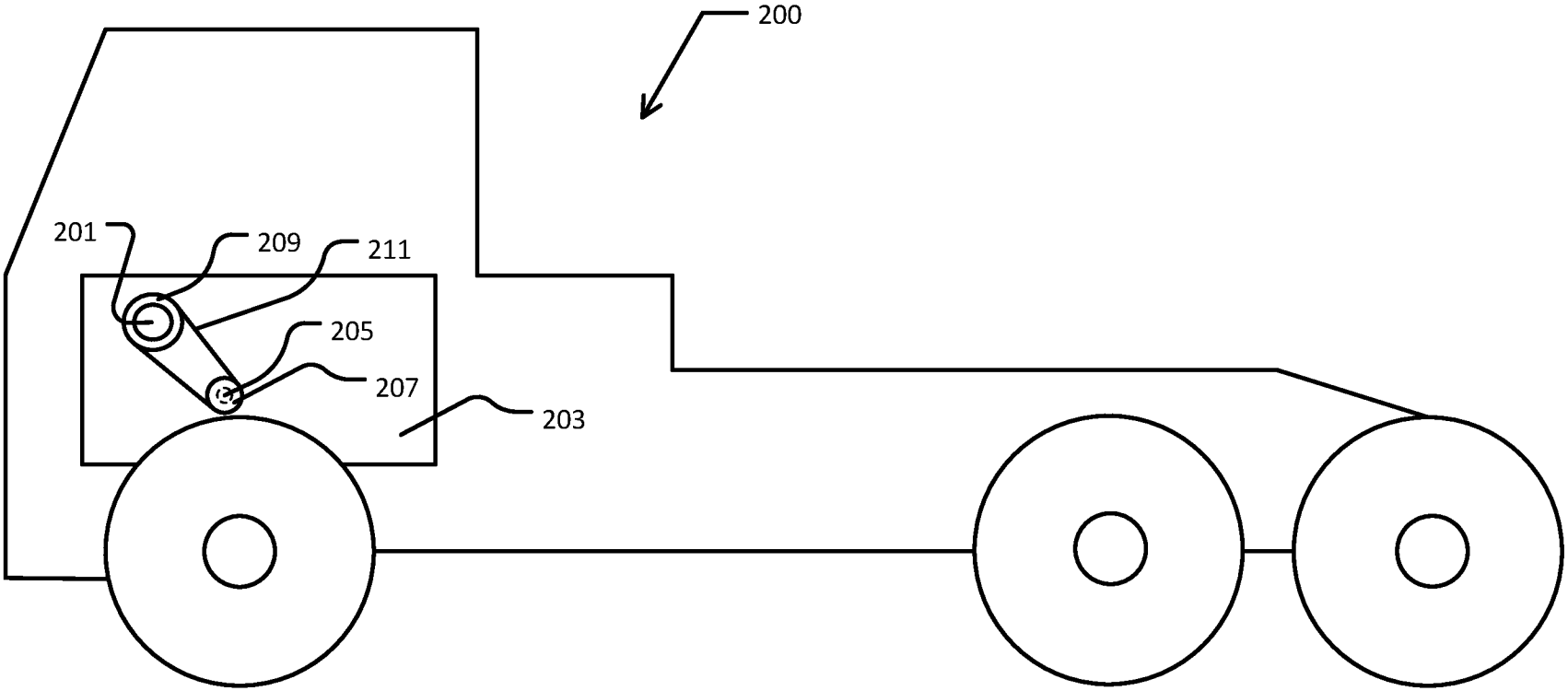
FIG. 4 illustrates schematically a vehicle comprising an internal combustion engine comprising a variable cam timing phaser arrangement according to the present disclosure.

The present invention also relates to an internal combustion engine and a vehicle comprising a variable cam timing phaser arrangement as described above. FIG. 4 shows schematically a heavy goods vehicle 200 having an internal combustion engine 203. The internal combustion engine has a crankshaft 205, crankshaft sprocket 207, camshaft (not shown), camshaft sprocket 209 and timing chain 211. The variable cam timing phaser arrangement 201 is located at the rotational axis of the cam sprocket/camshaft. An engine provided with such a variable cam timing phaser arrangement has a number of advantages such as better fuel economy, lower emissions and better performance as compared to a vehicle lacking cam phasing.

The invention claimed is:

1. A variable cam timing phaser arrangement for an internal combustion engine comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting a drive force;

wherein the at least one vane divides the at least one recess into a first chamber and a second chamber, the first chamber and the second chamber being arranged to receive hydraulic fluid under pressure, wherein an introduction of the hydraulic fluid into the first chamber causes the rotor to move in a first rotational direction relative to the stator and an introduction of the hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, the control assembly comprising:

a piloted valve located centrally within the rotor, the piloted valve comprising a pilot port, a first flow port in fluid communication with the first chamber, and a second flow port in fluid communication with the second chamber, wherein the piloted valve is switchable between an open state and a closed state by regulation of a pressure of a pilot fluid at the pilot port, wherein in the open state the piloted valve allows fluid communication between the first chamber and the second chamber, and in the closed state, the piloted valve prevents fluid communication between the first chamber and the second chamber;

a first check valve arranged in a fluid path between the piloted valve and the first chamber, the first check valve arranged to allow flow from the piloted valve to the first chamber, but to prevent flow from the first chamber to the piloted valve;

a solenoid-controlled actuator located remotely from rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port;

a central solenoid valve having a valve body arranged co-axially within the rotor and/or camshaft, the central solenoid valve comprising a first flow port in fluid communication with the first chamber and a second flow port in fluid communication with the second chamber, wherein the central solenoid valve is switchable between a closed state preventing fluid communication between the first chamber and the second chamber and an open state allowing fluid communication between the first chamber and the second chamber; and a second check valve arranged in a fluid path between the central solenoid valve and the second chamber, the second check valve arranged to allow flow from the central solenoid valve to the second chamber, and to prevent flow from the second chamber to the central solenoid valve.

2. The variable cam timing phaser arrangement according to claim 1, wherein the hydraulic fluid and/or pilot fluid is hydraulic oil.

3. The variable cam timing phaser arrangement according to claim 1, wherein the piloted valve is a 2/2 way on/off valve, arranged to be normally in the open state, and actuated by increased fluid pressure at the pilot port to switch to the closed state.

4. The variable cam timing phaser arrangement according to claim 1, wherein the solenoid-controlled actuator is a 3/2 way solenoid valve having an inlet port in fluid communication with a source of increased fluid pressure, an outlet port in fluid communication with the pilot port of the piloted valve, and a vent port, wherein the primary state of the 3/2 way solenoid valve is a de-energized state preventing fluid communication from the source of increased fluid pressure to the pilot port of the piloted valve and allowing fluid communication from the pilot port of the piloted valve to the vent port, and wherein the secondary state of the 3/2 way solenoid valve is an energized state allowing fluid communication from the source of increased fluid pressure to the pilot port of the piloted valve and actuating the piloted valve.

5. The variable cam timing phaser arrangement according to claim 1, wherein the solenoid-controlled actuator is a solenoid-driven piston arranged in a cylinder, the cylinder being arranged in fluid communication with the pilot port of the piloted valve, wherein in the primary state the solenoid-driven piston is in a retracted position relative to the cylinder, and wherein in the secondary state the solenoid-driven piston is actuated and moved to an extended position relative to the cylinder, whereby the pressure of the pilot fluid at the pilot port of the piloted valve is increased and the piloted valve is actuated.

6. The variable cam timing phaser arrangement according to claim 1, wherein the central solenoid valve is a 2/2 way on/off solenoid valve arranged to be normally in the closed state, and actuated by energizing the central solenoid valve to switch to the open state.

7. The variable cam timing phaser arrangement according to claim 1, wherein a source of increased fluid pressure is arranged in fluid communication with the first chamber and the second chamber via a first refill channel and a second refill channel, the first refill channel and second refill channel each having a check valve arranged to prevent fluid flow from the first chamber or second chamber to the source of increased fluid pressure.

8. The variable cam timing phaser arrangement according to claim 1, wherein the piloted valve, the central solenoid valve, the first check valve and the second check valve are integrated into a single integrated valve unit arranged co-axially with the rotor.

9. A method for controlling a timing of a camshaft in an internal combustion engine comprising a variable cam timing phaser arrangement comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting a drive force;

wherein the at least one vane divides the at least one recess into a first chamber and a second chamber, the first chamber and the second chamber being arranged to receive hydraulic fluid under pressure, wherein an introduction of the hydraulic fluid into the first chamber causes the rotor to move in a first rotational direction relative to the stator and an introduction of the hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, the control assembly comprising:

a piloted valve located centrally within the rotor, the piloted valve comprising a pilot port, a first flow port in fluid communication with the first chamber, and a second flow port in fluid communication with the second chamber, wherein the piloted valve is switchable between an open state and a closed state by regulation of a pressure of a pilot fluid at the pilot port, wherein in the open state the piloted valve allows fluid communication between the first chamber and the second chamber, and in the closed state, the piloted valve prevents fluid communication between the first chamber and the second chamber;

a first check valve arranged in a fluid path between the piloted valve and the first chamber, the first check valve arranged to allow flow from the piloted valve to the first chamber, but to prevent flow from the first chamber to the piloted valve;

a solenoid-controlled actuator located remotely from rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port;

a central solenoid valve having a valve body arranged co-axially within the rotor and/or camshaft, the central solenoid valve comprising a first flow port in fluid communication with the first chamber and a second flow port in fluid communication with the second chamber, wherein the central solenoid valve is switchable between a closed state preventing fluid communication between the first chamber and the second chamber and an open state allowing fluid communication between the first chamber and the second chamber; and a second check valve arranged in a fluid path between the central solenoid valve and the second chamber, the second check valve arranged to allow flow from the central solenoid valve to the second chamber, and to prevent flow from the second chamber to the central solenoid valve, wherein the method comprises:

i. providing the solenoid-controlled actuator in the secondary state, thereby providing the piloted valve in the closed state, and providing the central solenoid valve in the closed state;

ii. switching the solenoid-controlled actuator to the primary state, thereby switching the piloted valve to the open state, whereby fluid will flow from the second chamber to the first chamber due to periodic pressure fluctuations in the first chamber and the second chamber caused by torque acting on the camshaft, and whereby fluid is prevented from flowing from the first chamber to the second chamber, resulting in the rotor rotating in the first rotational direction relative to the stator and a cam timing being adjusted in a first temporal direction;

iii. maintaining the solenoid-controlled actuator in the primary state until a desired degree of cam timing phasing is achieved; and iv. switching the solenoid-controlled actuator to the secondary state, thereby switching the piloted valve to a closed state, whereby fluid communication between the first chamber and the second chamber is prevented and the desired degree of cam timing phasing is maintained.

10. A method for controlling a timing of a camshaft in an internal combustion engine comprising a variable cam timing phaser arrangement comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting a drive force;

wherein the at least one vane divides the at least one recess into a first chamber and a second chamber, the first chamber and the second chamber being arranged to receive hydraulic fluid under pressure, wherein an introduction of the hydraulic fluid into the first chamber causes the rotor to move in a first rotational direction relative to the stator and an introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, said the control assembly comprising:

a piloted valve located centrally within the rotor, the piloted valve comprising a pilot port, a first flow port in fluid communication with the first chamber, and a second flow port in fluid communication with the second chamber, wherein the piloted valve is switchable between an open state and a closed state by regulation of a pressure of a pilot fluid at the pilot port, wherein in the open state the piloted valve allows fluid communication between the first chamber and the second chamber, and in the closed state, the piloted valve prevents fluid communication between the first chamber and the second chamber;

a first check valve arranged in a fluid path between the piloted valve and the first chamber, the first check valve arranged to allow flow from the piloted valve to the first chamber, but to prevent flow from the first chamber to the piloted valve;

a solenoid-controlled actuator located remotely from rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port;

a central solenoid valve having a valve body arranged co-axially within the rotor and/or camshaft, the central solenoid valve comprising a first flow port in fluid communication with the first chamber and a second flow port in fluid communication with the second chamber, wherein the central solenoid valve is switchable between a closed state preventing fluid communication between the first chamber and the second chamber and an open state allowing fluid communication between the first chamber and the second chamber; and a second check valve arranged in a fluid path between the central solenoid valve and the second chamber, the second check valve arranged to allow flow from the central solenoid valve to the second chamber, and to prevent flow from the second chamber to the central solenoid valve, wherein the method comprises:

i. providing the solenoid-controlled actuator in the secondary state, thereby providing the piloted valve in the closed state, and providing the central solenoid valve in the closed state;

ii. switching the central solenoid valve to the open state, whereby fluid will flow from the first chamber to the second chamber due to periodic pressure fluctuations in the first chamber and the second chamber caused by torque acting on the camshaft, and whereby fluid is prevented from flowing from the second chamber to the first chamber, resulting in the rotor rotating in the second rotational direction relative to the stator and a cam timing being adjusted in a second temporal direction, wherein the second temporal direction is opposite to the first temporal direction;

iii. maintaining the central solenoid valve in an open state until a desired degree of cam timing phasing is achieved; and iv. switching the central solenoid valve to the closed state, whereby fluid communication between the first chamber and the second chamber is prevented and the desired degree of cam timing phasing is maintained.

11. An internal combustion engine comprising a variable cam timing phaser arrangement comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting a drive force;

wherein the at least one vane divides the at least one recess into a first chamber and a second chamber, the first chamber and the second chamber being arranged to receive hydraulic fluid under pressure, wherein an introduction of the hydraulic fluid into the first chamber causes the rotor to move in a first rotational direction relative to the stator and an introduction of the hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, said the control assembly comprising:

a piloted valve located centrally within the rotor, the piloted valve comprising a pilot port, a first flow port in fluid communication with the first chamber, and a second flow port in fluid communication with the second chamber, wherein the piloted valve is switchable between an open state and a closed state by regulation of a pressure of a pilot fluid at the pilot port, wherein in the open state the piloted valve allows fluid communication between the first chamber and the second chamber, and in the closed state, the piloted valve prevents fluid communication between the first chamber and the second chamber;

a first check valve arranged in a fluid path between the piloted valve and the first chamber, the first check valve arranged to allow flow from the piloted valve to the first chamber, but to prevent flow from the first chamber to the piloted valve;

a solenoid-controlled actuator located remotely from rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port;

a central solenoid valve having a valve body arranged co-axially within the rotor and/or camshaft, the central solenoid valve comprising a first flow port in fluid communication with the first chamber and a second flow port in fluid communication with the second chamber, wherein the central solenoid valve is switchable between a closed state preventing fluid communication between the first chamber and the second chamber and an open state allowing fluid communication between the first chamber and the second chamber; and a second check valve arranged in a fluid path between the central solenoid valve and the second chamber, the second check valve arranged to allow flow from the central solenoid valve to the second chamber, and to prevent flow from the second chamber to the central solenoid valve.

12. A vehicle comprising a variable cam timing phaser arrangement comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting a drive force;

wherein the least one vane divides the at least one recess into a first chamber and a second chamber, the first chamber and the second chamber being arranged to receive hydraulic fluid under pressure, wherein an introduction of the hydraulic fluid into the first chamber causes the rotor to move in a first rotational direction relative to the stator and an introduction of the hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, said the control assembly comprising:

a piloted valve located centrally within the rotor, the piloted valve comprising a pilot port, a first flow port in fluid communication with the first chamber, and a second flow port in fluid communication with the second chamber, wherein the piloted valve is switchable between an open state and a closed state by regulation of a pressure of a pilot fluid at the pilot port, wherein in the open state the piloted valve allows fluid communication between the first chamber and the second chamber, and in the closed state, the piloted valve prevents fluid communication between the first chamber and the second chamber;

a first check valve arranged in a fluid path between the piloted valve and the first chamber, the first check valve arranged to allow flow from the piloted valve to the first chamber, but to prevent flow from the first chamber to the piloted valve;

a solenoid-controlled actuator located remotely from rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port;

a central solenoid valve having a valve body arranged co-axially within the rotor and/or camshaft, the central solenoid valve comprising a first flow port in fluid communication with the first chamber and a second flow port in fluid communication with the second chamber, wherein the central solenoid valve is switchable between a closed state preventing fluid communication between the first chamber and the second chamber and an open state allowing fluid communication between the first chamber and the second chamber; and a second check valve arranged in a fluid path between the central solenoid valve and the second chamber, the second check valve arranged to allow flow from the central solenoid valve to the second chamber, and to prevent flow from the second chamber to the central solenoid valve.

* * * * *